United States Patent [19]

Wüsthof et al.

[11] Patent Number: 4,627,801

[45] Date of Patent: Dec. 9, 1986

[54] ROTARY GEAR MACHINE WITH COMMUTATOR AND SHAFT IN FLANGE HOUSING

[75] Inventors: Peter Wüsthof; Johann Schneider, both of Lohr; Ewald Schulz, Neuhuetten, all of Fed. Rep. of Germany

[73] Assignee: Mannesmann Rexroth GmbH, Fed. Rep. of Germany

[21] Appl. No.: 686,309

[22] Filed: Dec. 24, 1984

Related U.S. Application Data

[63] Continuation-in-part of Ser. No. 562,745, Dec. 19, 1983.

[51] Int. Cl.[4] ..... F01C 1/113; F03C 2/08

[52] U.S. Cl. ..... 418/61 B

[58] Field of Search ..... 418/61 B

[56] References Cited

U.S. PATENT DOCUMENTS

| | | | |
|---|---|---|---|
| 2,989,951 | 6/1961 | Charlson | 418/61 B |
| 3,453,966 | 7/1969 | Eddy | 418/61 B |
| 3,490,383 | 1/1970 | Parrett | 418/61 B |
| 3,627,454 | 12/1971 | Goff et al. | 418/61 B |
| 3,778,197 | 12/1973 | Takagi | 418/61 B |
| 4,426,199 | 1/1984 | Wusthof et al. | 418/61 B |

FOREIGN PATENT DOCUMENTS

| | | |
|---|---|---|
| 3119807 | 4/1981 | Fed. Rep. of Germany . |
| 3015551 | 10/1981 | Fed. Rep. of Germany . |

OTHER PUBLICATIONS

Rexroth Prospectus RD 14325, Dec. 1980, G. L. Rexroth GmbH, Jahnstrasse 3-5, D-8770 Lohr am Main, West Germany.

*Primary Examiner*—John J. Vrablik

*Attorney, Agent, or Firm*—Wigman & Cohen

[57] ABSTRACT

The present invention relates to a rotary piston machine comprising a housing which consists of a flange housing, an intermediate housing and an end housing. The flange housing has a flange extending there from landing the machine on a suitable support. A shaft is rotatively supported within the housing, and a rotor is fixedly mounted on the shaft and adapted to rotate together with the shaft. A hollow gear for farming compressing chambers is also located within the housing for cooperation with the rotor. A commutator is fixedly mounted within the flange housing means and is adapted to supply pressure medium to and to remove pressure medium from the compressing chambers.

6 Claims, 5 Drawing Figures

ROTARY GEAR MACHINE WITH COMMUTATOR AND SHAFT IN FLANGE HOUSING

CROSS-REFERENCE TO RELATED APPLICATION

This application is a continuation-in-part application of Ser. No. 562,745, filed Dec. 19, 1983.

BACKGROUND OF THE INVENTION

The invention relates to a rotary piston machine.

In a rotary piston machine of the above-described type, the arched (when viewed axially) bearing points on the outer side of the outer gear are formed as troughs, and the arched (also when viewed axially) support points are formed as rollers on the inside of the housing element surrounding the outer gear. The bearing points and the support points have large differences in their degrees of curvature, which results in a high compressive force with a high level of operating noise with limited dampening as the support points engage in the bearing ponts. The space required by a rotary piston machine formed in this manner is relatively large. An example of a rotary piston machine of this type is disclosed in German Offenlegungsschrift No. 30 15 551.

SUMMARY AND OBJECTS OF THE PRESENT INVENTION

The object of the present invention is to create a rotary piston machine in which the axially viewed bearing points and support points have arches with relatively large diameters. Practical tests have shown that the bearing points and the support points only come into contact on the outsides thereof and that it is sufficient to form only the contacting points with arches, particularly circular arches with the largest possible diameters. By this means, during engagement of the teeth of the outer gear into the tooth troughs of the housinq element, radii having only very slight differences in curvature meet each other, resulting in more surface contact. In addition, a lubricating film will last longer between bearing points and support points having large diameters than with smaller diameters. This results in a relatively high amount of dampening and a significantly quieter operation. Since with forcibly abutting arched surfaces of larger diameter, the compression is relatively small and the operational life of the rotary piston machine is increased. This type of machine can also be formed with a construction that saves a good deal of space.

In accordance with yet another aspect, the invention relates in its general terms to a compression machine. Specifically, the invention relates to a hydraulic motor of the type of a planet gear motor.

A planet gear motor of the type to which the present invention relates is shown in laid open German Patent Application No. 31 19 806.4. Also the prospectus RD 14 325-12.80 of Mannesmann Rexroth shows such a hydraulic motor to which the present invention relates.

Said known hydraulic motors comprise in essence the following: a control housing with a commutator fixedly mounted to said housing, a flange housing, a shaft, an intermediate housing, a compression unit including a rotor, a hollow gear, an outer gear, inner rollers and outer rollers, and a control disk.

Appropriate connections are provided to supply and remove the pressure medium. The pressure medium is supplied to the commutator (connecting body) via angular channels in the control housing. Due to the cooperation of the control openings of the commutator, secured in the housing, with the control disk, which rotates with the shaft, the pressure medium is supplied to or removed from said compressing chambers. The number of the compressing chambers equals the number of the inner rollers. Approximately half of the rotating compressing chambers are under pressure and create a rotary force at the rotor. As a consequence, the rotor will carry out a slow rotary movement about the axis of the shaft, while the hollow gear carries out a fast rotary movement around the axis of the shaft. The result is a large number of compressions per rotation of the shaft. The number of the compressing chambers per rotation of the shaft is the product of the number of inner rollers and the number of cycloide teeth of the hollow gear. The outer roller supports and guides the hollow gear. Even though the above described rotary piston machine works quite well, particularly if the machine is a hydraulic motor, there is a problem in so far as the machine is relatively large and can as a consequence not be used if space is at premium. The particular drawback of the known machine is the fact that the control housing together with the commutator (connecting body) requires a large amount of space.

During the operation of the known machine the reactory moment, which is created during operation has to be taken up by the intermediate housing. This means that the intermediate housing receives forces tending to create a deformation and said deformation forces are transmitted via the mounting screws (which connect the control housing, the intermediate housing and the flange housing) to the control housing with the consequence that the precision of the position with which the commutator is positioned is reduced. Since the commutator needs to be precisely oriented, the geometry of the control openings of the commutator deteriorates. Therefore the efficiency goes down and further the operation of the machine causes more noise than is desirable.

Primarily, the present invention intends to overcome the disadvantages of the prior art as outlined above.

One object of the present invention is to provide a hydraulic motor of a small size. Another object of the invention is to provide a hydraulic motor having a precisely located commutator. Another object of the invention is to provide a hydraulic motor with a low noise emission during operation.

In accordance with the present invention, the commutator is arranged in the flange housing and not, as is known, in the control housing. To arrange the commutator in the flange housing has the advantage that the deformation or the bending forces experienced by the intermediate housing are no longer transmitted via the screws to the commutator which is now secured in the flange housing. When the commutator is arranged in accordance with the invention in the flange housing, the control or end housing can be simply a compact plate. Preferably, within said plate a shaft bearing is provided.

The actual length of the machine is significantly reduced when using the design of the invention. Also a savings in material will occur.

The flange housing is used for mounting the hydraulic motor or the hydraulic machine and, as a consequence, said housing always has to have a large degree of strength. The location of the commutator within the flange housing will therefore not lead to a decrease in the precision of the positioning of the commutator, a decrease which is created by the moment of reaction in a machine of the prior art.

Further, it should be noted that the bearing adjacent the output end of the shaft extends beyond the area of the commutator. Therefore high forces may be received.

To have the bearing extended beyond the commutator is advantageous inasmuch as for many applications higher radial forces are applied to this bearing than to the opposite bearing in the end or control housing. Therefore, the elongated bearing provides for a high force receiving capacity.

Another advantage of a motor designed according to the invention resides in the fact that due to the stiffness of the flange housing the commutator can be simply pressed against the bottom of the flange housing without additional seals being necessary. Preferably, an axially fixedly mounted safety element is arranged between the control disk and the rotor, so as to receive axial forces of the shaft. Preferably said safety element is a so-called seeger ring. Using this seeger ring makes it possible that axial forces are either transmitted from the control disk to the flange housing, or alternatively from the rotor to the control or end housing.

With these and other objects, advantages and features of the invention that may become hereinafter apparent, the nature of the invention may be more clearly understood by reference to the following detailed description thereof, the appended claims, and the several views illustrated in the attached drawings, wherein.

BRIEF DESCRIPTION OF THE DRAWINGS

A rotary piston pump is schematically illustrated as an exemplary embodiment of the object of the invention.

DETAILED DESCRIPTION OF A PREFERRED EMBODIMENT

Figure 1:
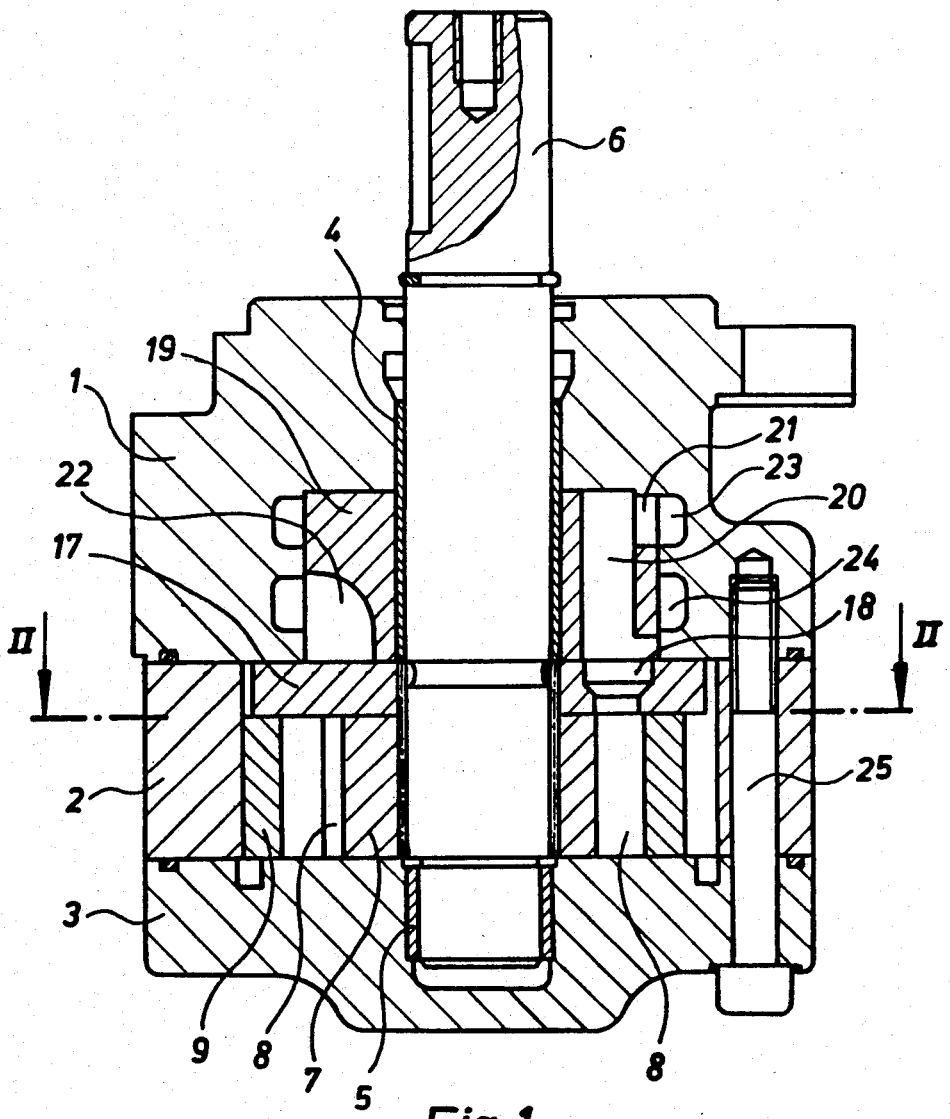
FIG. 1 is a longitudinal section according to the line I—I in FIG. 2.

The rotary piston pump has a housing 1, 2, 3 formed of a housing end element 1, a housing center element 2 and a cover 3. The housing end element 1 is formed as a shell, the housing center element 2 as a ring and the cover 3 as a disc. In the base of the housing end element 1 is located a bearing sleeve 4 in a through-bore, a bearing sleeve 5 is located in cover 3, and a rotor shaft 6 is rotatably mounted in the two bearing sleeves 4 and 5, and projects beyond the housing end element 1. In the area of the housing center element 2, an inner gear 7 is rotationally connected with the rotor shaft 6 by means of a serration. The rotor shaft 6 and the inner gear 7 arranged thereon can be driven by means of a motor (not shown).

Figure 2:
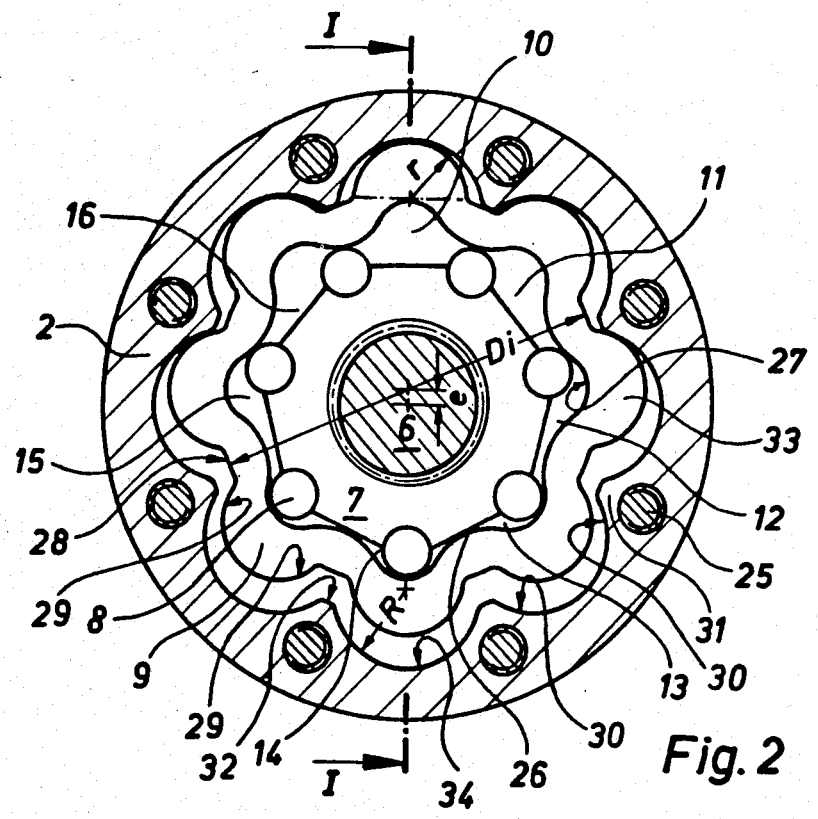
FIG. 2 is a cross section according to the line II—II in FIG. 1.

Seven teeth 8, which are each formed by a roller, are arranged at equal distances about the periphery of the inner gear 7 and project radially beyond its periphery. The inner gear 7 is surrounded by an outer gear 9, which is formed in an undulating manner and which is described in greater detail below. The outer gear 9 and the inner gear 7 form a compressing unit. The teeth 8 continuously abut the outer gear 9 and together therewith they form compressing chambers 10 through 16 (FIG. 2). The teeth 8 are rotatably mounted in corresponding recesses in the inner gear 7.

A control disc 17 is arranged between the compressing unit 7, 9 on the one side and the housing end element 1 on the other side. This control disc 17 is rotationally connected with the rotor shaft 6, so that the inner gear 7 and the control disc 17 borders the compressing chambers 10 through 16 on the side of the housing end element 1, and is laterally covered on the other side by the cover. The control disc 17 includes respective supply bores 18 which open between the teeth 8 of the inner gear 7 into the compressing chambers 10 through 16. These supply bores are uniformly distributed about the periphery of the control disc 17. Their number corresponds to the number of the compressing chambers 10 through 16. A connecting body 19 is nonrotatably placed in the housing end element 1, and has alternating longitudinal bores 20 with outwardly guided lateral channels 21 and respective angled channels 22 on the side thereof adjacent the control disc 17. The longitudinal bores 20 and the angled channels 22 thus alternatingly open on the side of the connecting body 19 facing the control disc 17. The number of longitudinal bores 20 and the number of angled channels 22 is always one greater than the number of compressing chambers 10 through 16. Accordingly, eight longitudinal bores 20 and eight angled channels 22 respectively are present, which are alternatingly and uniformly distributed about the circumference. The lateral channels 21 are connected with annular channel 23 and the angled channels 22 are connected with an annular channel 24. The lateral channels 21 communicate with a supply container (not shown) and the annular channel 24 communicates with a pressurized fluid circuit (also not shown) which is subject to a pressure medium force. The mounting sleeve 4, which is rigidly secured in the housing end element 1 extends through the connecting body 19. The housing end element 1, the housing center element 2 and the cover 3 are connected with each other by means of screws 25.

On its inner side the outer gear 9 has inwardly projecting circular-segment forming projections 26 as seen in FIG. 2, between which, as also seen in FIG. 2, circular-segment shaped recesses 27 are respectively provided for engagement with the teeth 8. The radius of the recess 27 is smaller than that of the projection 26. The outer gear 9 has on its outer surface cover, sections 28 of the circular cylinder having the diameter Di. As seen in FIG. 2, semi-circular teeth 33 are arranged therebetween, and include semi-circular bearing points 29 at their bases. The bearing points 29 are located on the side opposite the recesses 27. The radius of the bearing points 29 is designated with r. The center of the semicircle of the bearing points 29 is located between the circle determined by the cover sections 28 on the one side and the circle determined by the points of the recesses 27 lying farthest outward radially on the other side. In the exemplary embodiment the ratio r/Di lies between 0.155 and 0.145.

The outer gear 9 is arranged eccentrically to the shaft 6 and to the housing 1, 2, 3 by the amount e. On its inner side the housing center element 2 has support points 30 which are arranged on lateral edges of tooth troughs 34, are adapted to the bearing points 29 of the outer gear 9, and, viewed axially, also are shaped as circular segments. The radius R of these support points 30 is the sum of the radius r and the doubled amount of the eccentric distance e. Inwardly projecting teeth 31 are provided between the tooth troughs 34. The teeth 31 project so far beyond the bases of the tooth troughs 34 that, as illustated at the top of FIG. 2, they pass between teeth 33. A screw 25 is located in the vicinity of each of the teeth 31. The teeth 31 are fully formed and have tooth crown surfaces 32 which are component parts of a cylindrical cover section.

The method of operation of the rotary piston pump corresponds to that according to German Patent DE-OS No. 30 15 551.

Figure 3:
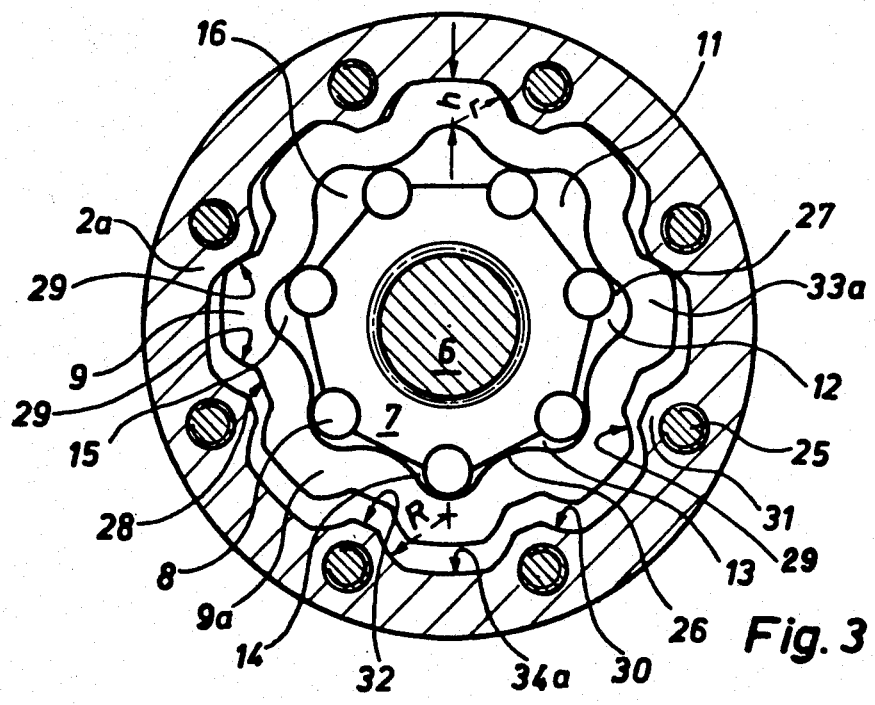
FIG. 3 is a cross section according to FIG. 2 with a different embodiment of elements.

In the exemplary embodiment according to FIG. 3, only the teeth 33*a* of the outer gear 9*a* having the bearing points 39, and the tooth troughs 34*a* of the housing center element 2*a* having the support points 30, are formed differently from the first exemplary embodiment. The teeth 33*a* are truncated at their radially extreme ends and the bases of the tooth troughs 34*a* are not as deep as the bases of the tooth troughs 34. Remaining are the bearing points 29 with the radius r in a common circular arc arranged on both sides of the base of the teeth 33*a* and the support points 30 with the radius R viewed respectively in the axial direction and arranged on both sides of the tooth troughs 34*a*. The height h of the teeth 33*a* is about $\frac{3}{4}$ that of the radius r. The crown surfaces of the teeth 33*a* lying along a circumferential circle as viewed in the axial direction are not supported during operation by the bases of the tooth troughs 34*a*, which when viewed axially also lie along a circumferential circle. The same is true for the first exemplary embodiment.

In both exemplary embodiments it has been shown that the teeth 33, 33*a* only contact the lateral edges of the tooth troughs 34, 34*a*, in the vicinity of their tooth bases. The cooperating points, which are shaped as circular segments when viewed axially, are designated above as bearing points 29 on the outer gear 9 or 9*a* and as support points 30 on the housing center element 2 or 2*a*. They form a steep angle of engagement.

The support points 30, 30*a* in the housing center element can be provided with bearing bushings made of a wear-resistant, hardened material.

The bearing points 29 and the support points 30 are designated above as being shaped as circular segments when viewed in the axial direction. The circular segment shape results from the fact that the outer gear 9 performs a circular movement about the axis of the rotor shaft 6 without any rotational motion. The number of teeth 33, 33*a* and the number of the teeth 31 are therefore always the same. They do not need to correspond, however, with the number of recesses 27 in the outer gear 9.

Figure 4:
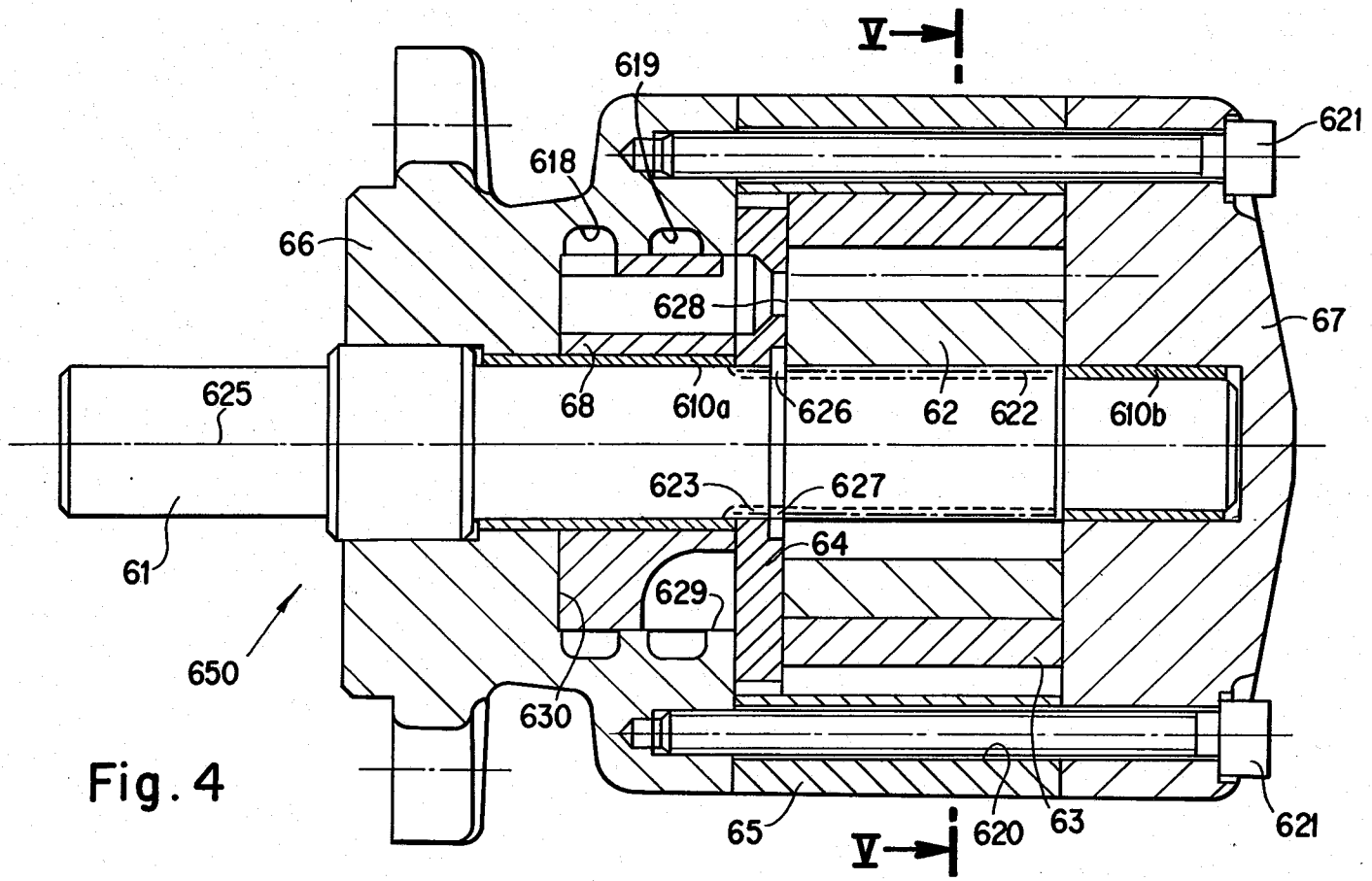
FIG. 4 is a schematic longitudinal section of a motor designed in accordance with the invention.
Figure 5:
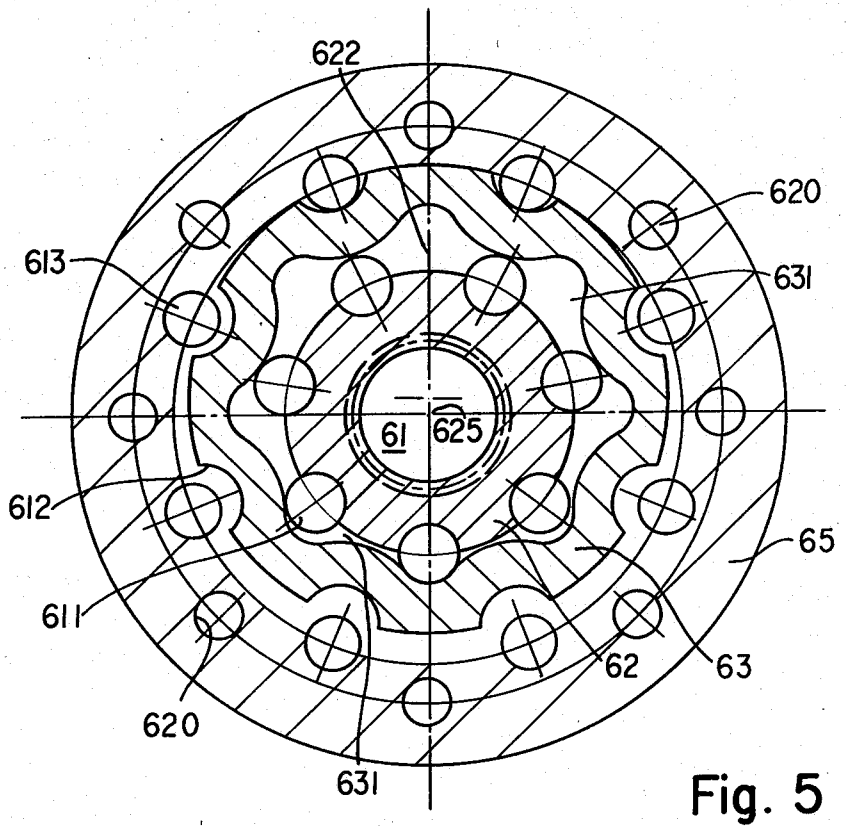
FIG. 5 is a cross section according to line V—V in FIG. 4.

FIGS. 4 and 5 relate to a rotary piston machine in the form of a hydraulic motor 650. The invention is preferably used in connection with a hydraulic motor and consequently the following description always refers to a hydraulic motor 650, even though the invention is not limited to use in hydraulic motors.

The hydraulic motor 650 has a housing which comprises preferably three components, i.e. a flange housing 66, an intermediate housing 65 and an end housing 67. Said three housing components are held together by a plurality of mounting screws 621. The mounting screws 621 extend through bores in the end housing 67 and the intermediate housing 65 and end in thread means which are provided in bores of flange housing 66. The bores in the intermediate housing are referred to by 620. On the longitudinal axis 625 of the motor 650 a rotary shaft 61 is arranged. Shaft 61 is journaled by means of a bearing 610*a* in flange housing 67. Fixedly mounted on the shaft 61 is an inner gear or rotor 62 and further a control disk 64. The control disk 64 is fixedly mounted to shaft 61 by means of serrations 623 and the rotor 62 is fixedly mounted to the shaft 61 by means of serrations 622. The serrations 622, 623 would allow an axial movement of rotor 62 and control disk 64, i.e. the shaft 61 might be moved out of the motor housing in case axial forces occur. So as to make this impossible a safety element 626 in the form of a seeger ring (c-clip) is mounted on shaft 61 and extends in radial direction into a relief portion 627 in the control disk 64. At the same time, the safety element 626 abuts at the inwardly pointed face 628 of rotor 62. A commutator (connecting body) 68 necessary for the operation of the motor 650 is pressed into a circular bore 629 provided in the flange housing 66. The commutator 68 is pressed into said bore 629 such that the commutator 68 sealingly abuts with its flat side against the bottom 630 of the bore 629 so that no additional seal means are necessary.

Within the flange housing 66 two annular grooves 618 and 619 are arranged adjacent to the commutator 68. Said grooves 618 and 619 are adapted to supply and remove, respectively, pressure medium depending on whether the operation as a motor or the operation as a pump is desired. The commutator 68 is of known design, for example of a design shown for the hydraulic motor of the above mentioned prospectus RD 14 325-12.80.

The commutator 68 together with the control disk 64, which is also known from the above mentioned prospectus, provides for a supply and removal, respectively, of pressure medium from the compressing chambers 631 during the rotation of the shaft 61. Said compressing chambers 631 are formed between said rotor 62 and the hollow gear 63 surrounding said rotor 62.

Therefore, for the preferred operation as a motor, the rotor 62 and consequently the shaft is rotated in a known matter. For this purpose the rotor, which is of substantially septangular (seven angles or seven corners) shape comprises at its outer perimeter at each of its corners a roller 611. Each of said rollers 611 cooperates with the inner perimeter of the hollow gear 63. The hollow gear 63 is provided at its outer perimeter with eight circular recesses 612 having the same size. The hollow gear 63 is on its inner side undulated in such a manner that it always abuts at all rollers 611 arranged at the rotor 62. The intermediate housing 65 supports at its inner circumference eight supporting rollers 613 which are arranged concentrically with respect to the rotor 62 and which are equidistantly spaced with respect to each other. Each of said supporting rollers 613 cooperates with one of said recesses 612 at the outer side of the hollow gear 63. Said hollow gear 63 is eccentrically located with respect to the axis 625. The seven compressing chambers 631 are defined in the embodiment as shown on the one hand by the rotor 62 and its roller 611 and on the other hand by the hollow gear 63. Each one control channel of said control disc 64 ends in said compressing chambers 631.

As already mentioned the basic design and operation of the commutator 68 and of the control disc 64 for the activation of the rotor 62 and the hollow gear 63 is known from the prior art so that a detailed description thereof would not appear to be necessary here. It is, however, important to note that in accordance with the present invention and different from the teaching of the prior art the commutator regardless of what shape it has, is arranged within the flange housing 66, i.e., in the housing portion which is arranged at the output end of the shaft 61. The housing portion which is arranged opposite to the flange housing 63 can therefore be relatively flat and may have the form of the end housing 67. End housing 67 only needs to receive the bearing 610*b* for the inner end of shaft 61.

Preferably, the bearing 610*a* for shaft 61, i.e., the bearing which is at the output end of the shaft 61 is provided not only in the area of the commutator 68, but extends beyond the commutator (in the drawing towards the left) into the flange housing 66. This is advantageous insofar as high bearing forces can be taken up by the bearing.

Although only preferred embodiments are specifically illustrated and described herein, it will be appreciated that many modifications and variations of the present invention are possible in light of the above teachings and within the purview of the appended claims without departing from the spirit and intended scope of the invention.

What we claim is:

1. A rotary piston machine comprising:

a housing;

flange housing means on said housing for mounting the machine on suitable support means;

a shaft rotatably supported within said housing;

a rotor fixedly mounted on said shaft and adapted to rotate together with said shaft;

a hollow gear for forming compressing chambers in cooperation with said rotor;

a commutator fixedly mounted within said housing and adapted to supply pressure medium to, and to remove pressure medium from, said compressing chambers;

wherein said shaft extends out of said flange housing means and said commutator is located in said flange housing means and is fixedly mounted therein against rotation, wherein the commutator has a flat side and is press-fit into an axial bore of said flange housing means and sealingly abuts with the flat side against the bottom of the bore; a control disc arranged between the commutator and the rotor, and a safety element provided between the control disc and the rotor, said safety element being fixedly secured with respect to displacement in the axial direction of said shaft, said safety element being located in relief means of said control disc, and wherein said safety element further abuts at a face of the rotor which faces towards said flange housing means.

2. The rotary piston machine according to claim 1, wherein said housing comprises the flange housing means, an intermediate housing and an end housing, wherein said commutator is fixedly mounted within said flange housing means.

3. The rotary piston machine according to claim 2, wherein the flange housing means, the intermediate housing and the end housing are connected to each other by means of mounting screws which extend in an axial direction.

4. The rotary piston machine according to claim 2, further comprising bearing means for said shaft, said bearing means comprising first bearing means arranged in said end housing and second bearing means arranged within said flange housing means, said second bearing means extending in the axial direction of said machine beyond said commutator into said flange housing means.

5. The rotary piston machine according to claim 2, wherein annular grooves are provided in the flange housing means adjacent to the commutator so as to provide for the supply and the removal of pressure medium.

6. The rotary piston machine according to claim 1, wherein said control disc and said rotor are each mounted to said shaft by means of serrations for common rotation with said shaft.

* * * * *